United States Patent [19]

Doyle et al.

[11] Patent Number: 4,816,360

[45] **Date of Patent: * Mar. 28, 1989**

[54] MULTICOLOR HOLOGRAMS USING GELATIN AS THE BINDER AND METHOD FOR PRODUCING THE SAME

[75] Inventors: James Doyle, Wilmslow; David W. Butcher, Goostrey; John A. Clark, Altrincham, all of England

[73] Assignee: Ciba-Geigy AG, Basel, Switzerland

[ * ] Notice: The portion of the term of this patent subsequent to Sep. 6, 2005 has been disclaimed.

[21] Appl. No.: 940,050

[22] Filed: Dec. 10, 1986

[30] Foreign Application Priority Data

Dec. 11, 1985 [GB] United Kingdom ..... 8530459

[51] Int. Cl.[4] ..... G03C 1/04; G03C 5/00; G03C 5/04

[52] U.S. Cl. ..... 430/2; 430/1; 430/394; 430/396; 430/401; 430/642

[58] Field of Search ..... 430/1, 2, 401, 642, 430/394, 396

[56] References Cited

U.S. PATENT DOCUMENTS 4,173,474 11/1979 Tanaka et al. ..... 430/2
4,244,633 1/1981 Kellie ..... 430/1
4,563,024 1/1986 Blyth ..... 350/320
4,656,106 4/1987 Holland et al. ..... 430/2

FOREIGN PATENT DOCUMENTS 0814288 6/1959 United Kingdom .
2166908 10/1983 United Kingdom .

OTHER PUBLICATIONS

J. W. Gladden, Review of Photosensitive Materials for Halographic Recordings, Technical Report, U.S. Army Engineer Topographic Laboratories, Fort Belvoir, VA 22060, #ETL-0128, Apr. 1978.

*Primary Examiner*—Mukund J. Shah
*Attorney, Agent, or Firm*—Wenderoth, Lind & Ponack

[57] ABSTRACT

Multicolor holograms using gelatin as the binder and having interference fringes lying in layers parallel to the substrate, the colors of which are visible by reflection in incident natural light, by treating the holographic material which has been holographically exposed and processed to produce a hologram therein, by applying to the selected areas of the gelatin which contains the interference fringes a solution of a compound which causes the interference fringes to separate permanently and produce a bathochromic shift in the replay wavelength.

18 Claims, No Drawings

MULTICOLOR HOLOGRAMS USING GELATIN AS THE BINDER AND METHOD FOR PRODUCING THE SAME

This invention relates to multicolor holograms in which a unique feature has been incorporated in the hologram and which is reconstructed as a different colour to the remainder of the hologram.

The holograms of the present invention are of particular use in identification and security cards.

Identification cards are well known, both for visual and machine inspection. In the latter case, it is relatively easy to build codes into the card, which codes may not be visually apparent, to enable the machine to verify only an authentic card, and it can readily be made extremely difficult to forge a card which will deceive the machine.

However, identification cards for visual inspection by the human eye to verify the holder can more readily be forged, because it is difficult to incorporate into the card a unique feature which, although readily apparent to the eye, is not readily reproducible.

In British Pat. No. 2116908 there is described an identificaion and/or security device which incorporates a multi-color hologram having interference fringes lying in layers parallel to the substrate, the colours of which are visible by reflection in incident natural light, wherein the film emulsion has been selectively deformed differently in different areas of the hologram in order to produce the multiple colours.

The term "reflection", as used above and hereinafter, is employed in the conventional context applicable to holography, wherein images are seen by light returned from the hologram to the same side thereof from which the light is incident, although it will be understood that the "reflected" imaged are in fact produced by a special case of diffraction.

The images and colours of the hologram will readily be apparent in any artificial or other "white" or non-monochromatic light such as daylight, generally referred to herein as natural light.

Thus, in order to provide the hologram with colours which are visible in reflected light, the film emulsion is permanently deformed, selectively in different regions of the area of the hologram. The interference fringes generated with a hologram viewed by reflected light-normally lie in layers parallel to the substrate, and the spacing between these layers of fringes, in the direction of normal to the substrate, are altered at the regions of deformation. The effect of this is to change the wavelength of the reflected light emanating from these regions of the hologram.

Selective deformation produces a multi-colour hologram. This results in a hologram which is virtually non-reproducible, even by the most practical method, which is the Denisyuksingle beam system using a tunable dye laser, because if the laser is initially tuned to one colour, other regions of the hologram of different colour will become "fogged" and reproduction at these latter regions then produces a very unsatisfactory result to the would-be forger, even if the laser is subsequently returned to the different colour.

In said British Pat. No. 2116908 the method of deforming the film emulsion selectively is to cause the film emulsion to shrink in selected areas. This produces a hyposchromic shift in the replay wavelength of those areas of the hologramwhere the emulsion has been shrunk. This shrinking is carried out during the processing of the hologram. It is particularly directed to producing holograms wherein the colour of the hologram is gradually shaded from one end of the hologram to the other end or to the production of a hologram which has a striped coloured pattern.

We have found a method of producing a multi-coloured hologram wherein the emulsion can be deformed in a more readily controllable manner.

According to the present invention there is provided a method of preparing a multicolor hologram which uses gelatin as the binder having interference fringes lying in layers parallel to the substrate, the colous of which are visible by reflection in incident natural light, which comprises treating the holographic material, which has been holographically exposed and processed to produce a hologram therein, by applying to selected areas of the gelatin which contains the interference fringes a solution of a compound which causes the interference fringes to separate permanently and produce a bathochromic shift in the replay wavelength.

Thus in the areas of the holographic material to which the solution has been applied the interference fringes separate and a bathochromic shift in the replay wavelength is exhibited when the hologram is reconstructed.

Preferably the hologram is dried after processinag before the solutions of the compound which causes the interference fringes to separate is applied. This solution can be applied by means of a paint brush, a pen, a rubber stamp, a finger or by any other means by means of which the solution can be supplied to a selected area of the hologram.

Three main classes of compounds have been identified which can cause the interference fringes in a gelatine silver halide hologram to separate permanently. These are:

(a) onium compounds which compriseat least one alkyl group having 10 to 18 carbon atoms or on which the total number of carbon atoms in the substituent groups is at least 15 or a polymeric compound which comprises at least one onium group in the repeating unit.

(b) a compound which has an molecular weight over 200 and which reacts with the gelatin to form covalent bonds therewith to increase the molecular bulk of the gelatin.

(c) a water-soluble polymer which comprises a tertiary amine group either in the repeating unit or in a side chain.

Most preferably the compound which causes the interference fringes to separate permanently is applied to the hologram as an aqueous solution but it can be applied in a solvent which does not affect the gelatin.

Examples of onium compounds (a).

Preferably the onium compound is a quaternary ammonium compound.

One class of useful quaternary ammonium compounds have the general formula I:

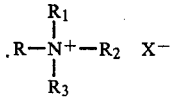

I wherein R is a straight chain alkyl group having 10 to 18 carbon atoms, $R_1$ and $R_2$ are each alkyl groups having 1 or 2 carbon atoms and $R_3$ is either an alkyl group having 1 to 2 carbon atoms, or an aralkyl group or a cycloalkyl group or a group of formula II

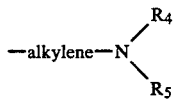

II where $R_4$ and $R_5$ an each alkyl groups having 1 or 2 carbon atoms, or $R_1$, $R_2$ and $R_3$ represent the atoms necessary to complete a hetrocyclic aromatic ring group and X is an anion.

Preferably X is halogen for example Cl or Br. Another useful anion is methosulphate.

Preferably $R_1$, $R_2$, $R_4$ and $R_5$ are each methyl.

Examples of particularly useful compounds of formula I are:

Cetyl pyridiium bromide

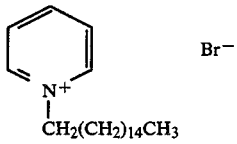

N-dodecyldimethylbenzyl ammonium chloride

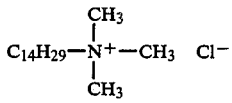

N-myristyltrimethyl ammonium chloride

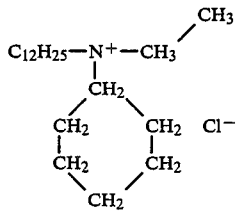

N-dodecyldimethylcyclohexyl ammonium chloride and the compound of the formula III:

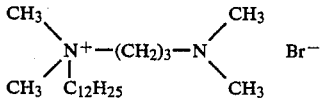

III

Other useful compounds have the general formula IV:

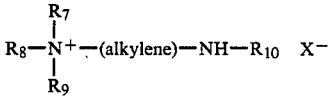

IV where $R_7$ and $R_8$ are each alkyl groups having 1 and 2 carbon atoms, $R_9$ is an optionally substituted alkyl group, (alkylene) is an alkylene radical which may be substituted or interrupted by heteroatoms, $R_{10}$ is a group which comprises an alkyl group having 10 to 18 carbon atoms and X is an anion.

A useful compound of formula IV has the formula:

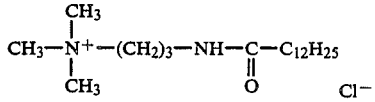

Another class of useful quaternary ammonium compounds have the general formula V:

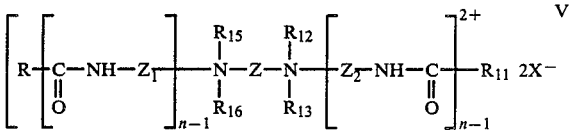

V wherein $R_{17}$ and $R_{11}$ are each aliphatic hydrocarbon radicals containing 12 to 18 carbon atoms, $R_{12}$, $R_{13}$, $R_{15}$ and $R_{16}$ are optionally substituted alkyl, cycloalkyl or aralkyl radicals, Z is an optionally substituted alkylene linking group which may comprise hetro atoms, $Z_1$ and $Z_2$ are alkylene radicals containing 2 or 3 carbon atoms, n is an interger of at most 2 and X is an anion.

Preferably n is 1.

Particularly useful compounds are those wherein $R_{17}$ and $R_{11}$ are each straight chain alkyl radical having 12 to 18 carbon atoms, Z is a low molecular weight alkylene radical containing 2–4 carbon atoms optionally substituted by hydroxyl groups, $R_{12}$, $R_{13}$, R15 and R16 are each alkyl groups comprising one or two carbon atoms and X is a halogen atom.

An especially useful compound hereinafter referred to as compound A, has the formula VI:

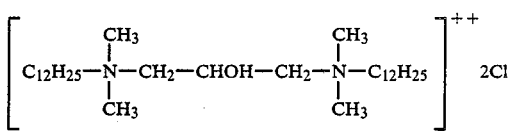

VI

Compounds of the formulae V and VI are described in British patent specification No. 849532.

Polymeric compounds whichare related to the bisquaternary compound of formula VI are high molecular weight condensation products formed by reacting a compound of the general formula VII:

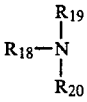

and heating this compoundto form a high molecular weight condensation compound.

A useful compound of formula VIII which may be condensed to form high molecular weight compounds has the formula:

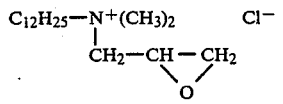

Another useful class of polymeric compounds are prepared by quaternising a diamine of the formula IX:

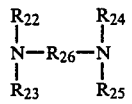

where $R_{22}$, $R_{23}$, $R_{24}$ and $R_{25}$ are each alkyl groups having 1 or 2 carbon atoms and $R_{26}$ is an alkylene group which may be substituted or interrupted with hetero atoms with bischloromethyldiphenyl to yield a polymer having the repeating unit of formula X:

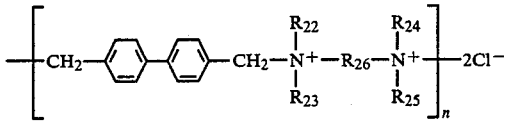

wherein $R_{22}$, $R_{23}$, $R_{24}$, $R_{25}$ and $R_{26}$ have the meanings just assigned to them and n is 10–15.

A particularly useful repeating unit of formula X has the formula:

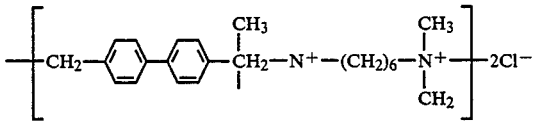

Most of the quaternary ammonium compounds as just described have found use as so called 'retarding agents' in the dyeing of textile materials.

Another useful polymeric compound having quaternary ammonium groups in the repeating unit is polydimethyldiallylammonium chloride.

Other useful onium compounds are phosphonium, arsonium and sulphonium compounds.

A useful concentration of the solution of onium compounds to use is from 1 to 20 g per 100 ml of water.

A particularly useful class of gelatin reactive compounds (b) are the aldehyde condensation compounds described in British patent specification No. 814288.

These compounds have a very complex structure and can be best defined by their process of manufacture as set forth in No. 814288 wherein it states that there is provided a process for the manufacture of condensation products, wherein a non-cyclic compound containing at least once the atomic grouping

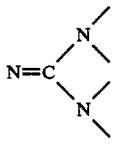

is condensed in a first stage with an aldehyde and a salt of an aliphatic amine containing at least two primary or secondary amino groups at a temperature above 100° C., and the product so obtained is further condensed in a second stage with an aldehyde and a water-soluble ammonium salt or amine salt in the presence of a solvent.

A particularly useful range of condensation compounds are obtained when the aldehyde used in the first stage condensation and in the second stage condensation is in each case formaldehyde.

Preferably the salt of an aliphatic amine used is a salt of ethylene diamine. Also preferably the water-soluble ammonium salt used in the second stage condensation is ammonium chloride.

As non-cyclic compounds which contain at least once the grouping

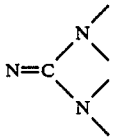

there may be used, guanidine, acetoguanidine, biguanide or substitution products of those compounds such as alkyl-biguanides or aryl-biguanides. Most preferably, however, the non-cyclic compound used is dicyandiamide.

An especially useful compound is obtained which is the reaction product of formaldehyde, ammonium chloride, dicyandiamide and ethylene diamine in a molar ratio of 2:1:1:0:1. This compound is hereinafter referred to as Condensate 1.

When a condensate of the type described in B.P. 814288 is used to treat the holographic material a greater effect is observed the higher the pH used. Also a greater effect is observed using an elevated temperature.

Another useful group of compounds of this class are the commercially available compounds made by Degussa under the trade name of QUAB which have a molecular weight of over 200.

Another useful class of compounds are the so-called reactive dyestuffs which comprise at least one dyrophilic group and at least one group which can react with a textile such as wool, cotton or silk.

Reactive dyestuffs were developed to dye cottons and rayons; others have been developed to dye wool and silk. It would be thought that as gelatin has a greater similarity with wool or silk than cellulose the reactive dyestuffs which can be used primarily for wool or silk only could be used in the method of the present invention. However, it ha been found that a number of reactive dyestuffs which are used for cellulose can also be used in the method of the present invention.

Reactive dyes comprise a chromophore group and a reactive group.

Examples of reactive groups are substituted monoazine, diazine-, triazine-, oxazine-, pyridine-, pyrimidine-, pyridazine-, pyrazine- and thiazine-rings and rings of this type which are annelated for example, phthalazine, quinoline, quinazoline, quinoxaline and acridine rings.

Other examples of reactive groups are acryloyl and mono-, di-ortrichloroacryloyl for example-CO CH=CH Cl and other substituted acryloyl groups such as -methylsulphonylacryloyl and protected acryloyl goups. Also vinyl sulphone groups and protected vinyl sulphone groups.

A long list of reactive groups is given in European patent application No. 134033.

Examples of reactive groups which have been used in commercial reactive dyes are:

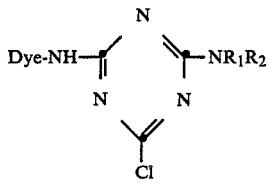

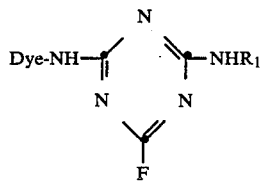

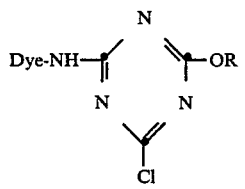

Dye-NHCOCHBr—$CH_2$Br, or Dye-NHCOCBr=$CH_2$

Dye-$SO_2$—$CH_2CH_2OSO_3H$

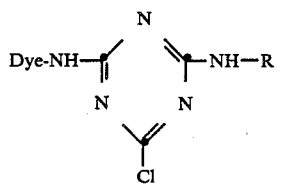

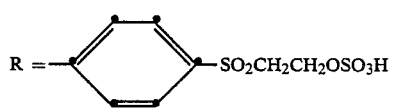

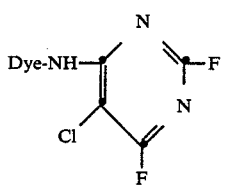

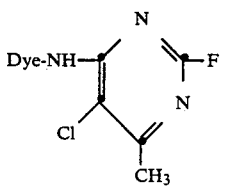

-continued

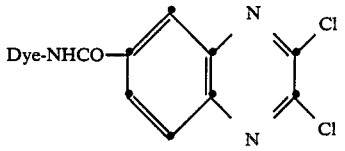

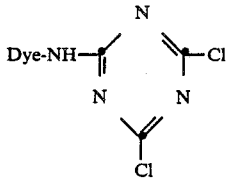

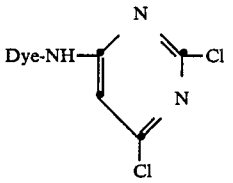

In most cases the 'Dye' moiety comprises a water-solubilising group.

The nature of the dye chromophore is not important in the method of the present invention, but chromophores present include azo, anthroquinone and phthalocyanine groups.

An example of class (c) polymers are polymers formed by reacting methylene bisacrylamide or substituted derivatives thereof with a compound which comprise two secondary amine groups.

Examples of useful compounds which comprise two secondary amine groups are:

piperazine 4,4'bipiperidine, 4,4'-ethylene dipiperidine, 2,5-dimethyl-piperazine and N,N'-dimethylethylene diamine.

Examples of polymers which comprise a tertiary amino group in a side claim are polymers which have a repeating unit of the general formula XI:

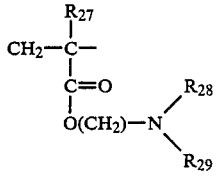

where $R_{27}$ is hydrogen or a methyl group $R_{28}$ and $R_{29}$ are each selected from optionally substituted alkyl, aralkyl or aryl groups and n is 2–4, or $R_{28}$ and $R_{29}$ represent the atoms necessary to complete a saturated hetrocylic ring.

Preferably $R_{28}$ and $R_{29}$ are each methyl or ethyl. Polymers which comprise the repeating unit of formula II may be homopolymers or copolymers.

Examples of polymers which comprise a repeating unit of formula XI are polydimethylaminoethylmethacrylate and polymorpholinoethyl methacrylate.

In the process of the present invention preferably a hologram is prepared from silver halide sensitised holographic material wherein the binder for the silder halide is gelatin. Ater the holographic exposure to produce the parallel fringes the usual processing sequence is silver halide development using a silver halide developing agent for example hydroquinone, followed by a silver bleaching process.

The silver bleaching step may be any process fo removing the developed silver, but which leaves the unexposed silver halide in situ. It is to be understood that the developed silver may be converted to silver halide some of which may remain in the holographic material.

Examples of bleaching techniques are solvent bleaching methods in which the developed silver is removed from the material and rehalogenating bleaching methods, in which the developed silver is converted to silver halide.

After the hologram has been prepared it is treated in selected areas with a solution of a compound which causes the interference fringes of the hologram to separate permanently.

Alternatively the hologram may be a dichromated gelatin type wherein a wet process to remove the unhardened gelatin followed by a dehydrating process to form the interrerence fringes is employed.

Preferably an aqueous solution of one of the classes of compound (a), (b) or (c) as hereinbefore set forth is used.

The following example will serve to illustrate the invention.

EXAMPLE

Samples of holographic material were prepared by coating onto a transparent photographic film base a gelatino silver halide emulsion which was substantially pure silver bromide having a mean crystal size of 0.03 microns at a silver coating weight of 30 mg/dm$^2$. The emulsion was optically sensitised with a red sensitising dye so that it was optimally sensitive to 633 n.m. the colour of a He:Ne laser.

The material was holographically exposed by a Denisyuk exposure method using a brushed aluminium plate as an object to yield (after processing) a reflective hologram.

The material was then developed for 2 minutes in a solution of the following formulation:

| | |
|---|---|
| Sodium Sulphite Anhydrous | 30 g |
| Hydrogunone | 10 g |
| Sodium Carbonate | 60 g |
| Water to | 1000 ml |

The samples were then transferred to rehalogenating bleach bath of the following composition:

| | |
|---|---|
| Fe(NH$_4$)EDTA(1.8 m Solution) | 150 mls |
| KBr | 20 g |
| Water to | 1000 mls |

until all silver metal had been bleached out which was about 2 minutes.

The samples were then water washed in running water for 1 minute and then dried.

An absorbent material attached to a handle and fabricated to form the letter 'D' was then placed in the Solution A as set forth below and then was pressed on to the gelatin layer of the hologram as just prepared and left there for 2 minutes. The holographic material was then water washed for 1 minute in running water, dried and then replayed to exhibit a reflection hologram. In three similar tests the absorbent material in the shape of a letter 'D' was placed in solution B, C and D as set forth below.

There was visible in the holographic material a greenish hologram of the brushed aluminium plate. Superimposed on the image was the red letter 'D'. Because of the way the fringes of the hologram had been separated in the area which had been in contact with the absorbent material the letter 'D' was not in the same place as the hologram of the brushed aluminium plate but appeared as a water-mark in front of the hologram.

Solution A was a 10% aqueous solution of comound A which is a quaternary ammonium compound class (a).

Solution B was a 10% aqueous solution of condensate 1 which is compound of class (b).

Solution C was a 5% aqueous solution of an orange dyestuf of the formula:

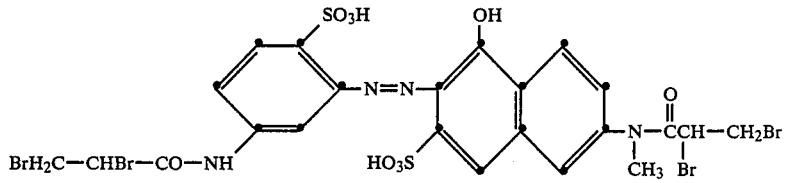

which is also a compound of class (b).

Solution D was 1% aqueous solution of polydimethylaminoethylmethacrylate which is a class (c) compound.

As the period of contact of the solution was only 2 minutes the bathochromic shift in every case appeared to be about the same. However, in the case of solution C the letter 'D' was visible in ordinary ambient light as an orange colour 'D' which is the colour of the reactive dye used.

In order to show the versatility of the method of the present invention in security applications a hologram of an eagle was prepared on similar material as just prepared.

After the hologram had been dried on absorbent writing instrument was placed in solution B and a signature was written on to the halogen in one corner thereof. A finger of the person who wrote the signature was then dipped in solution B and then this finger was pressed on the hologram at another corner. After the hologram had been washed and re-dried it was replayed to exhibit a greenish hologram of an eagle with two reddish water-marks one of the signature and the other of the finger print.

Such a combination hologram is to all intents and purposes impossible to copy.

We claim:

1. A method of preparing a multicolor hologram which uses gelatin as the binder having interference fringes lying in layers parallel fo the substrate, the colors of which are visible by reflection in incident natural light, which comprises treating the holographic material which has been holographically exposed and processed to produce a hologram therein, by applying to the selected areas of the gelatin which contains the interference fringes a solution of a compound which causes the interference fringes to separate permanently and produce a bathochromic shift in the replay wavelength.

2. A method according to claim 1 wherein the compound which causes the interference fringes to separate permanently is an onium compound which comprises at least one alkyl group having 10 to 18 carbon atoms or in which the total number of carbon atoms in the substituent groups is at least 15 or a polymeric compound which comprises at least one onium group in the repeating unit.

3. A method according to claim 1 wherein the onium compound is a quaternary ammonium compound.

4. A method according to claim 2 wherein the quaternary ammonium compoundhas the formula:

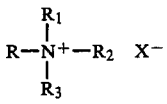

wherein R is a straight chain alkyl group having 10 to 18 carbon atoms, $R_1$ and $R_2$ are each alkyl groups having 1 or 2 carbon atoms and $R_3$ is either an alkyl group having 1 to 2 carbon atoms, or an aralkyl group or a cycloalkyl group or a group of the formula

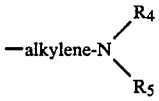

where $R_4$ and $R_5$ are each alkyl groups having 1 or 2 carbon atoms, or $R_1$, $R_2$ and $R_3$ represent the atoms necessary to complete a heterocyclic aromaticring group and X is an anion.

5. A method according to claim 3 wherein the quaternary ammonium compound has the formula:

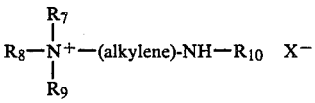

where $R_7$ and $R_8$ are each alkyl groups having 1 or 2 carbon atoms, $R_9$ is an optionally substituted alkyl group, (alkylene) is an alkylene radical which may be substituted or interrupted by heteroatoms, $R_{10}$ is a group which comprises an alkyl group having 10 to 18 carbon atoms and X is an anion.

6. A method according to claim 2 wherein the quaternary ammonium compound has the formula

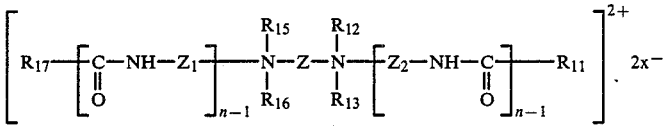

wherein $R_{17}$ and $R_{11}$ are each aliphatic hyrocarbon radicals containing 12 to 18 carbon atoms, $R_{12}$, $R_{13}$, $R_{15}$ and $R_{16}$ are optionallysubstituted alkyl, cycloalkyl or aralkyl radicals, Z is an optionally substituted alkylene linking group which may comprise 2 or 3 carbon atoms, n is an integer of at most 2 and X is an anion.

7. A method according to claim 6 wherein the formula of the quaternary ammonium compoundset forth therein $R_{17}$ and $R_{11}$ are each straight chain alkyl radical having 12 to 18 carbon atoms, Z is a low molecular alkylene radical containing 2–4 carbons atoms optionally substituted by hydroxyl groups, $R_{12}$, $R_{13}$, $R_{15}$ and $R_{16}$ are each alkyl groups comprising one or two more carbon atoms and X is a halogen atom.

8. A method according to claim 7 wherein the quaternary ammonium compound is of the formula

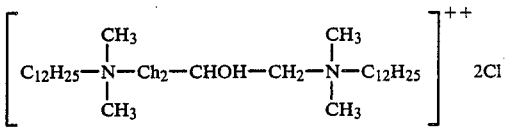

9. A method according to claim 3 wherein the quaternary ammonium compound is a polymer which has been prepared by quaternising a diamine of the formula:

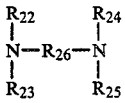

where $R_{22}$, $R_{23}$ and $R_{25}$ are each alkyl groups having 1 or 2 carbon atoms and $R_{26}$ is an alkylene group which may be substituted or interrupted with hetero atoms with bischloromethyldiphenyl.

10. A method according to claim 1 wherein the compound which causes the interference fringesto separate permanently is a compound which has an molecular weight over 200 and which reacts with the gelatin to form covalent bonds therewith to increase the molecular bulk of the gelatin.

11. A method according to claim 10 wherein the compound which reacts with gelatin is a condensation compound obtained by condensing a non-cyclic compound containing at least once the atomic grouping

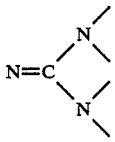

in a first stage with an aldehyde and a salt of an aliphatic amine containing at least two primary or secondaryamino groups at a temperature above 100° C., and the product so obtained is further condensed in a second stage with an aldehyde and a water-soluble ammonium salt or amine salt in the presence of a solvent.

12. A method according to claim 10 wherein the compound which reacts with gelatin is a reactive dyestuff.

13. A method according to claim 12 wherein the reactive dyestuff comprises a chromophore group and a reactive group selected from substituted mono-azine, diazine-, triazine-, oxazine-, pyridine-, pyrimidine-, pyridazine-, pyrazine- and thiazine-rings and rings of this type which are annelated, acryloyl and mono-, di-ortrichlorcacryloyl groups, protected acryloyl groups, vinyl sulphone groups and protected vinyl sulphone groups.

14. A method according to claim 1 wherein the compound which causes the interference to separate permanently is a water-soluble polymer which comprises a tertiary amine group either in the repeating unit or in a side chain.

15. A method according to claim 14 wherein the water-soluble polymer is a polymer formed by reacting methylene bisacrylamide or a substituted derivative thereof with a compound which comprises two secondary amine groups.

16. A method according to claim 14 wherein the polymer which comprises a tertiary amino group in a side chain is a polymer which has a repeating unit of the formula:

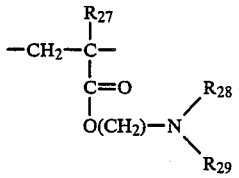

where $R_{27}$ is hydrogen or a methyl group $R_{28}$ and $R_{29}$ are each selected from optionally substituted alkyl, aralkyl or aryl groups and n is 2–4, or $R_{28}$ and $R_{29}$ represent the atoms necessary to complete a saturated heterocyclic ring.

17. A method according to claim 16 wherein the polymer is poly(dimethylaminoethylmethacrylate) or poly(morpholinoethylmethacrylate).

18. A hologram prepared by the method according to claim 1.

* * * * *